US010246876B2

(12) United States Patent
Brean

(10) Patent No.: US 10,246,876 B2
(45) Date of Patent: Apr. 2, 2019

(54) ADJUSTABLE BRACKET FOR RAISING A PATIO ROOF AND METHOD OF USE

(71) Applicant: Ernie Brean, San Diego, CA (US)

(72) Inventor: Ernie Brean, San Diego, CA (US)

( * ) Notice: Subject to any disclaimer, the term of this patent is extended or adjusted under 35 U.S.C. 154(b) by 0 days.

(21) Appl. No.: 15/968,533

(22) Filed: May 1, 2018

(65) Prior Publication Data

US 2018/0334801 A1 Nov. 22, 2018

Related U.S. Application Data

(60) Provisional application No. 62/507,454, filed on May 17, 2017.

(51) Int. Cl.
*E04B 7/16* (2006.01)

(52) U.S. Cl.
CPC ..... *E04B 7/163* (2013.01)

(58) Field of Classification Search
CPC .. E04B 7/163; E04B 7/045; E04B 2001/2415; E04B 2001/2439; E04B 2001/405; E04B 7/02; E04B 2001/2616; E04B 2001/2448; E04B 2001/2644; E04B 1/2604; E04B 1/2608
See application file for complete search history.

(56) References Cited

U.S. PATENT DOCUMENTS 1,787,167 A * 12/1930 Purdy ..... E04B 1/2604 16/249
2,848,765 A * 8/1958 Showalter ..... E04F 10/08 108/152
3,164,353 A * 1/1965 Rene ..... E04G 3/26 248/237
3,423,898 A * 1/1969 Coloney ..... E04B 1/2608 403/4
3,533,587 A * 10/1970 Smith ..... E04F 10/08 248/228.5
3,749,428 A * 7/1973 Hustead ..... E04B 7/02 403/156
3,984,951 A * 10/1976 Hindman ..... E04B 7/00 52/91.3
4,144,691 A * 3/1979 Hindman ..... E04B 7/00 52/461
4,148,164 A * 4/1979 Humphrey ..... E04D 13/158 52/105
4,154,028 A * 5/1979 Spaulding ..... E04B 7/00 52/60
4,275,532 A * 6/1981 Watson ..... E04D 13/004 52/101

(Continued)

FOREIGN PATENT DOCUMENTS

DE 202012004101 U1 7/2012
DE 202012104717 U1 4/2014
JP 3157733 U 3/2010

*Primary Examiner* — James M Ference
(74) *Attorney, Agent, or Firm* — Procopio Cory Hargreaves and Savitch LLP

(57) ABSTRACT

An adjustable bracket for raising a patio roof comprising an attachment mechanism attachable to a fascia or eave on a side of a residential structure; a bracket mechanism configured to raise, support, and attach a patio roof member or joist above the fascia or eave; and an adjustment mechanism to provide an adjustment angle of the bracket mechanism relative to the attachment mechanism to accommodate different roof angles.

6 Claims, 3 Drawing Sheets

(56) References Cited

U.S. PATENT DOCUMENTS 4,826,122 A * 5/1989 Cupp ..... E04G 3/26 248/237
5,067,675 A * 11/1991 Brant ..... E04D 13/0725 248/48.2
5,192,059 A * 3/1993 Silver ..... B25B 5/145 269/41
5,379,859 A * 1/1995 Pigman ..... E04G 3/26 182/45
5,381,844 A * 1/1995 Struben ..... E04H 15/08 135/88.1
5,570,864 A * 11/1996 Flores ..... E04G 3/26 248/148
5,647,451 A * 7/1997 Reichel ..... E04G 21/3214 182/113
5,788,204 A * 8/1998 Goodwin ..... E04G 3/26 248/357
5,799,680 A * 9/1998 Dorflinger ..... E04G 5/12 135/116
5,975,471 A * 11/1999 Dishman ..... E04B 7/02 182/45
6,240,682 B1 * 6/2001 James ..... E04B 7/024 52/712
6,519,900 B1 * 2/2003 Pierce ..... E04B 1/24 52/274
6,772,570 B2 * 8/2004 Home ..... E04B 7/045 52/640
6,820,868 B1 * 11/2004 Reymus ..... E04D 13/158 269/152
7,748,429 B2 * 7/2010 Caire ..... E04F 10/0607 160/113
7,891,144 B2 * 2/2011 Gilstrap ..... E04B 7/045 52/712
7,918,054 B2 4/2011 Grafton et al.
7,992,351 B1 * 8/2011 Kramer ..... E04F 10/00 52/68
8,191,336 B2 * 6/2012 Roberts ..... E04D 13/158 269/41
8,640,420 B1 * 2/2014 Halley ..... E04F 10/08 52/650.1
9,139,999 B2 * 9/2015 Nicholls ..... E04B 1/2612
9,822,524 B1 * 11/2017 Meznarich ..... F16M 13/02
2002/0189194 A1 * 12/2002 Santa Cruz ..... E04D 13/158 52/749.1
2006/0059794 A1 * 3/2006 Gilstrap ..... E04B 7/045 52/90.1
2006/0185311 A1 * 8/2006 Attalla ..... E04B 7/045 52/639
2007/0292204 A1 * 12/2007 Hackney ..... E04B 1/10 403/93
2009/0211177 A1 * 8/2009 Grafton ..... E04B 7/02 52/93.1
2011/0278410 A1 * 11/2011 Mai ..... E04B 7/045 248/237
2013/0212955 A1 * 8/2013 Lethin ..... E04B 7/04 52/58
2014/0109492 A1 * 4/2014 Lethin ..... E04D 3/3608 52/90.2
2015/0284952 A1 * 10/2015 Hilliaho ..... E04B 1/0046 52/11
2016/0040430 A1 * 2/2016 Lethin ..... E04D 3/3608 52/58
2018/0112391 A1 * 4/2018 Pace ..... E04B 1/0046

* cited by examiner

ADJUSTABLE BRACKET FOR RAISING A PATIO ROOF AND METHOD OF USE

FIELD OF THE INVENTION

The present invention related to systems and method for raising patio roofs.

SUMMARY OF THE INVENTION

An aspect of the invention involves an adjustable bracket for raising a patio roof. The adjustable bracket is made of sheet metal and is either attached to fascia on side of house or attached to rafters on side of house. The bracket may be adjustable to accommodate different roof angles. The adjustable bracket can be made in different models to raise a patio roof from 12 inches to 24 inches above the bottom of the fascia board or rafters.

Another aspect of the invention involves an adjustable bracket for raising a patio roof, comprising an attachment mechanism attachable to a fascia or eave on a side of a residential structure; a bracket mechanism configured to raise, support, and attach a patio roof member or joist above the fascia or eave; and an adjustment mechanism to provide an adjustment angle of the bracket mechanism relative to the attachment mechanism to accommodate different roof angles.

One or more implementations of the aspect described immediately above include one or more of the following: the attachment mechanism includes a rectangular flat plate that is attachable to the fascia; parallel flanges extending perpendicularly from the plate; the flanges each include a hole that receives a fastener to secure the adjustment angle of the bracket mechanism relative to the attachment mechanism; the adjustable bracket includes a rain gutter support assembly attached to the rectangular flat plate; the attachment mechanism includes a rectangular flat plate, perpendicularly extending, parallel rafter attachment plates, and a support plate joining the attachment plates to form a recess between the attachment plates to accommodate a rafter for connection therewith; the adjustable bracket includes a rain gutter support assembly between the rectangular flat plate and the parallel rafter attachment plates; the bracket mechanism includes parallel side walls, an end wall spanning the parallel side walls, and an internal support structure; the side walls each include arc-shaped slots that receive a fastener to secure the adjustment angle of the bracket mechanism relative to the attachment mechanism; adjacent to the end wall, the bracket mechanism includes a receiving channel to receive a patio member or joist; a pivot member to enable the bracket mechanism and the attachment mechanism to pivot relative to each other to accommodate different roof angles; the adjustable bracket is sized to raise the patio roof at least 12 inches above a bottom of the fascia board or rafters; and/or the adjustable bracket is sized to raise the patio roof at least 24 inches above a bottom of the fascia board or rafters.

Another aspect of the invention involves a method of using the adjustable bracket of the aspect of the invention described above comprising using adjustment mechanism to provide desired adjustment angle of the bracket mechanism relative to the attachment mechanism to accommodate roof angle; locking into position the bracket mechanism at desired adjustment angle relative to the attachment mechanism; attaching the attachment mechanism to the fascia or eave on the side of the residential structure; and securing the patio roof member or joist within bracket mechanism above the fascia or eave.

One or more implementations of the aspect described immediately above include one or more of the following: the attachment mechanism includes a rectangular flat plate that is attachable to the fascia; parallel flanges extending perpendicularly from the plate; the flanges each include a hole that receives a fastener to secure the adjustment angle of the bracket mechanism relative to the attachment mechanism; the adjustable bracket includes a rain gutter support assembly attached to the rectangular flat plate; the method further comprising removing a rain gutter from the house, and supporting the rain gutter by the rain gutter assembly; the attachment mechanism includes a rectangular flat plate, perpendicularly extending, parallel rafter attachment plates, and a support plate joining the attachment plates to form a recess between the attachment plates to accommodate a rafter for connection therewith; the adjustable bracket includes a rain gutter support assembly between the rectangular flat plate and the parallel rafter attachment plates; the bracket mechanism includes parallel side walls, an end wall spanning the parallel side walls, and an internal support structure; the side walls each include arc-shaped slots that receive a fastener to secure the adjustment angle of the bracket mechanism relative to the attachment mechanism; adjacent to the end wall, the bracket mechanism includes a receiving channel to receive a patio member or joist; a pivot member to enable the bracket mechanism and the attachment mechanism to pivot relative to each other to accommodate different roof angles; the adjustable bracket is sized to raise the patio roof at least 12 inches above a bottom of the fascia board or rafters; and/or the adjustable bracket is sized to raise the patio roof at least 24 inches above a bottom of the fascia board or rafters.

DETAILED DESCRIPTION OF THE INVENTION

Figure 1:
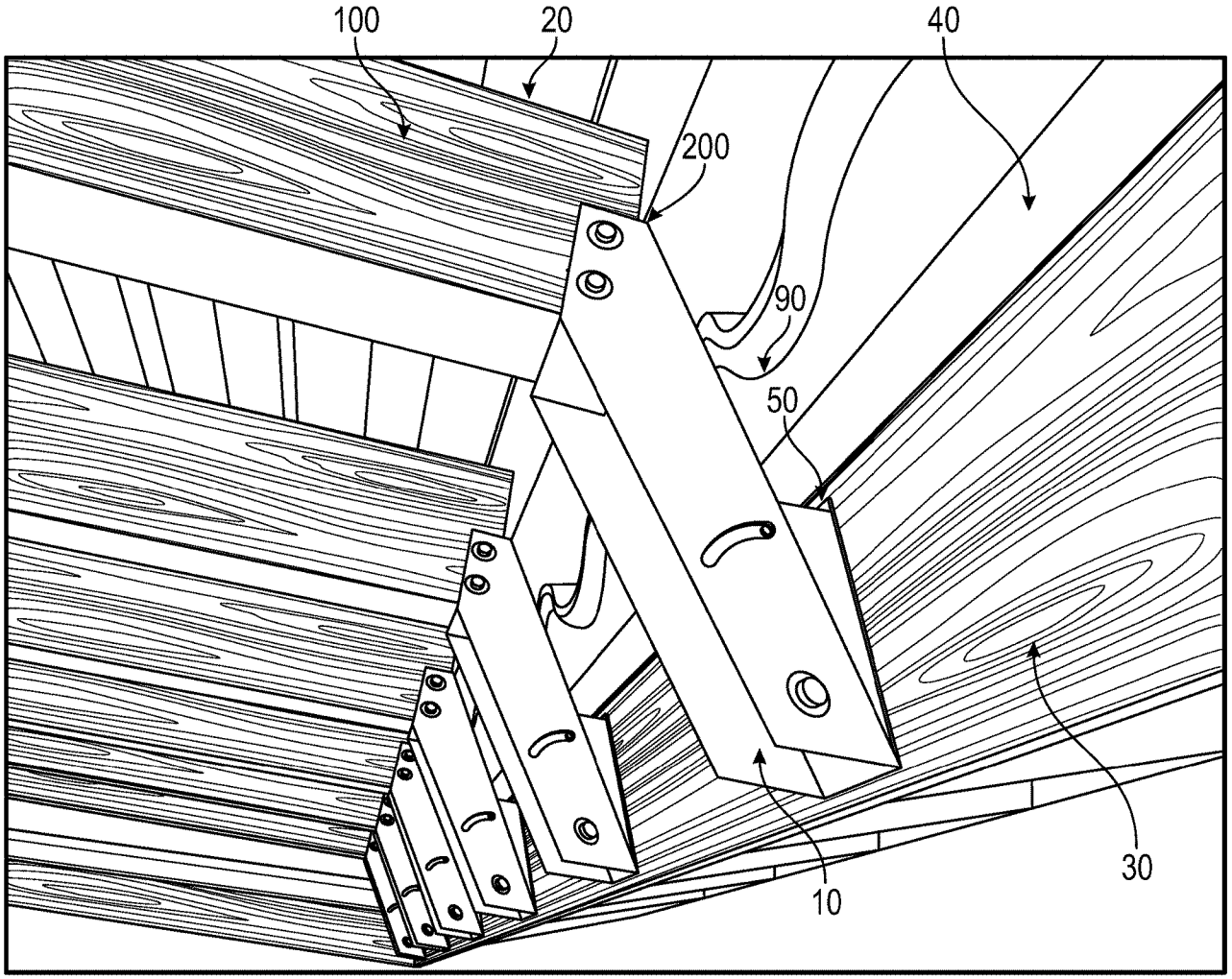
FIG. 1 is a perspective view of an embodiment of adjustable bracket for raising a patio roof attached to a fascia on a side of a house and shows the raised patio roof.
Figure 2:
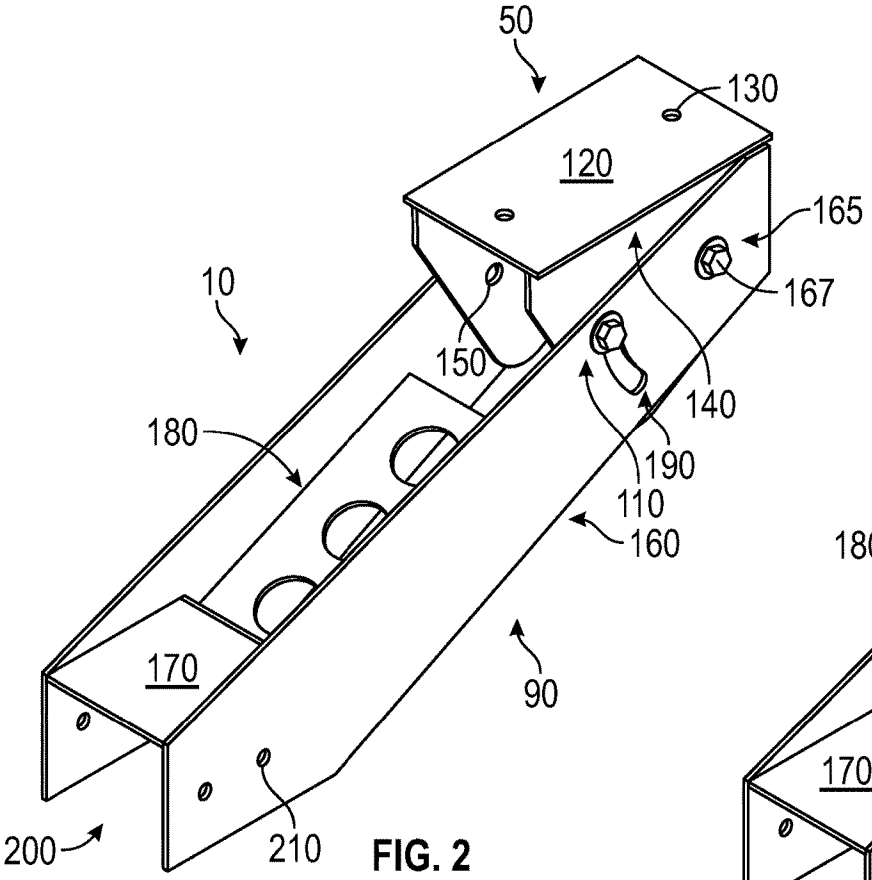
FIG. 2 is another embodiment of adjustable bracket for raising a patio roof.

With reference initially to FIGS. 1 and 2, an embodiment of an adjustable bracket 10 for raising a patio roof 20 will be described. The adjustable bracket 10 is attached to a fascia 30 on a side of a residential structure (e.g., house, condo, etc.) 40.

The adjustable bracket 10 is made of sheet metal and includes an attachment mechanism 50 for attaching the adjustable bracket 10 to the fascia 30 on the side of the house 40, a bracket mechanism 90 for raising, supporting, and attaching patio roof members/joists 100 above fascia 30, and an adjustment mechanism 110 for adjusting an angle of the bracket mechanism 90 relative to the attachment mechanism 50 to accommodate different roof angles.

The attachment mechanism 50 includes a rectangular flat plate 120 with fastener holes 130 that receive fasteners for attaching the adjustable bracket 10 to the fascia 30. Parallel flanges 140 extend perpendicularly from the plate 120. The flanges 140 include respective holes 150 that receive fasteners for securing an adjustment angle of the bracket mechanism 90 relative to the attachment mechanism 50.

The bracket mechanism 90 includes parallel side walls 160, end wall 170 spanning the distance between the parallel side walls 160, and internal support structure 180. The side walls 160 include respective holes 165 at the attachment mechanism 50 that receive pivot member(s) 167 to enable the bracket mechanism 90 and the attachment mechanism 50 to pivot relative to each other to accommodate different roof angles. The side walls 160 include respective arc-shaped slots 190 that receive the fasteners for securing an adjustment angle of the bracket mechanism 90 relative to the attachment mechanism 50. The flanges 140, pivot member (s), holes 165, arc-shaped slots 190, and fasteners form the adjustment mechanism 110 for adjusting an angle of the bracket mechanism 90 relative to the attachment mechanism 50 to accommodate different roof angles. Adjacent to the end wall 170, the bracket mechanism 90 includes a patio member/joist receiving channel 200. In this area, the side walls 160 include holes 210 that receive fasteners for securing patio member/joist 100 within channel 200.

In use, the adjustment angle of the bracket mechanism 90 relative to the attachment mechanism 50 is determined and locked into position. Then, the attachment mechanism 50 is attached to fascia 30 with fasteners. Then, the patio member/joist 100 is positioned within channel 200 and the patio member/joist 100 is secured to the bracket mechanism 90 with fasteners. Instead of installing the adjustable brackets 10 and the patio members/joists 100 one at a time, before adding all of the patio members/joists 100, all of the adjustable brackets 10 may first be secured in their proper positions to the fascia 30 followed by adding and securing all of the patio members/joists 100 to the adjustable brackets 10.

Figure 3:
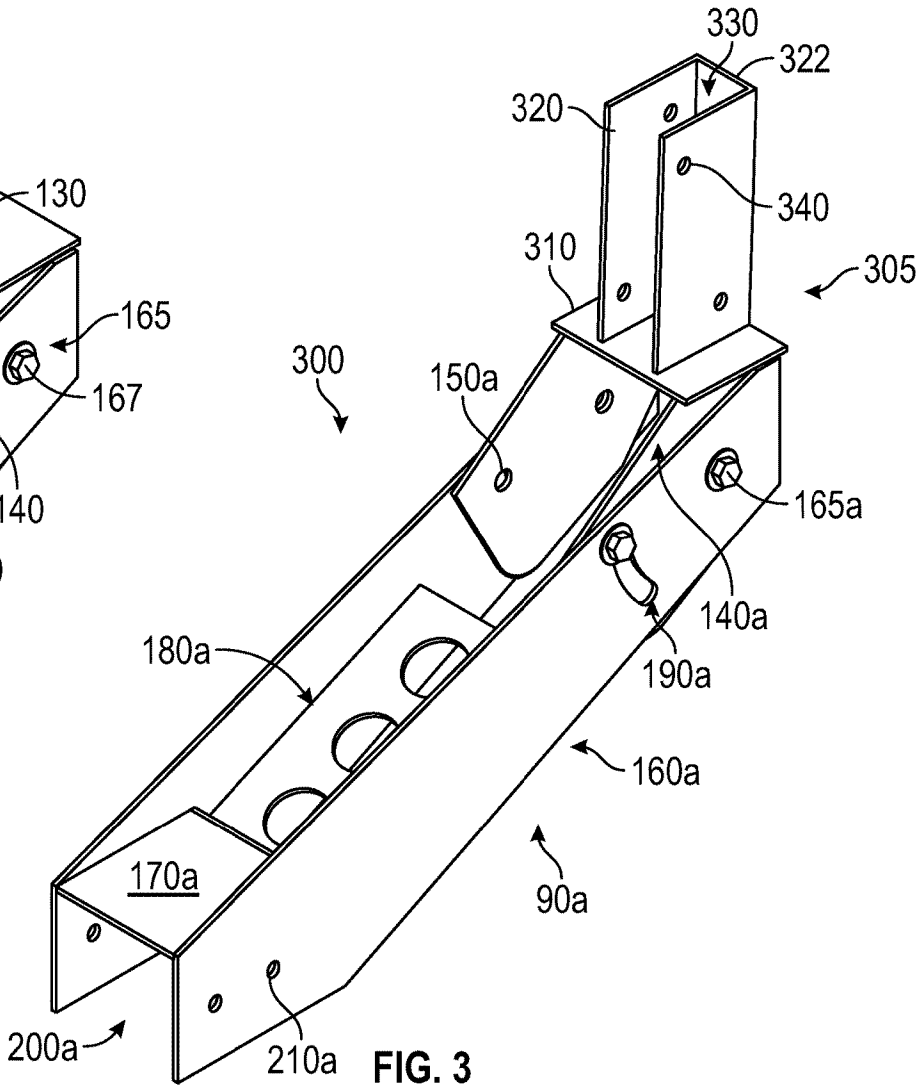
FIG. 3 is a further embodiment of adjustable bracket for raising a patio roof.

With reference to FIG. 3, another embodiment of an adjustable bracket 300 is shown. Like elements to those in adjustable bracket 10 are shown with like reference numbers, but with an "a" suffix, and are not described in further detail below (description above is incorporated herein). A main difference between the adjustable bracket 300 and the adjustable bracket 10 is that instead of the attachment mechanism 50 including the large rectangular flat plate 120, the adjustable bracket 300 has an attachment mechanism 305 having a small rectangular flat plate 310, perpendicularly extending, parallel rafter attachment plates 320, and support plate 322 joining attachment plates 320. A recess 330 is disposed between the attachment plates 320 to accommodate a rafter for connection therewith. The rafter attachment plates 320 includes holes 340 therein to accommodate fasteners for securing the rafter attachment plates 320 to the rafters.

In use, the adjustable bracket 300 is used in a similar manner to that described above, which is incorporated herein, but instead of attaching the adjustable brackets 10 to the fascia 30 via the large rectangular flat plate 120, the adjustable brackets 300 are attached to the rafters via the rafter attachment plates 320.

The adjustable brackets 10, 300 allow one to raise a patio roof compared to patio roof heights in the past and by connecting the adjustable brackets 10, 300 to the fascia board 30 or rafters compared to other locations (e.g., roof), damage and/or water leaks in the roof are prevented.

In one or more embodiments, the adjustable brackets 10, 300 come in different models to raise a patio roof from 12 inches to 24 inches above the bottom of the fascia board 30 or rafters.

Figure 5:
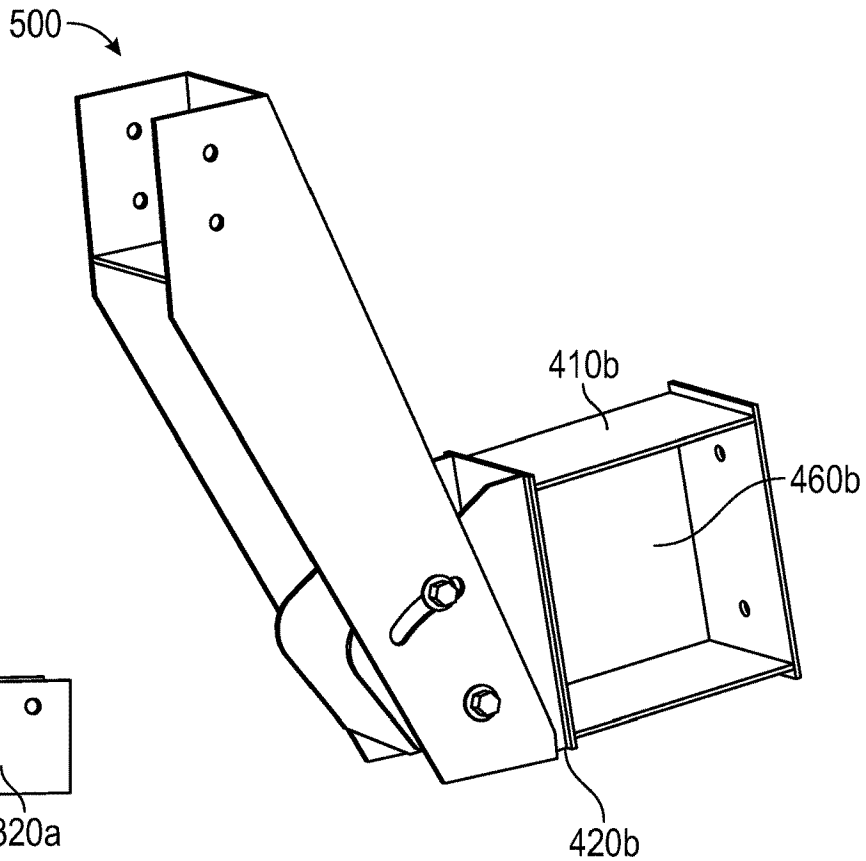
FIG. 5 is a still further embodiment of adjustable bracket for raising a patio roof.
Figure 4:
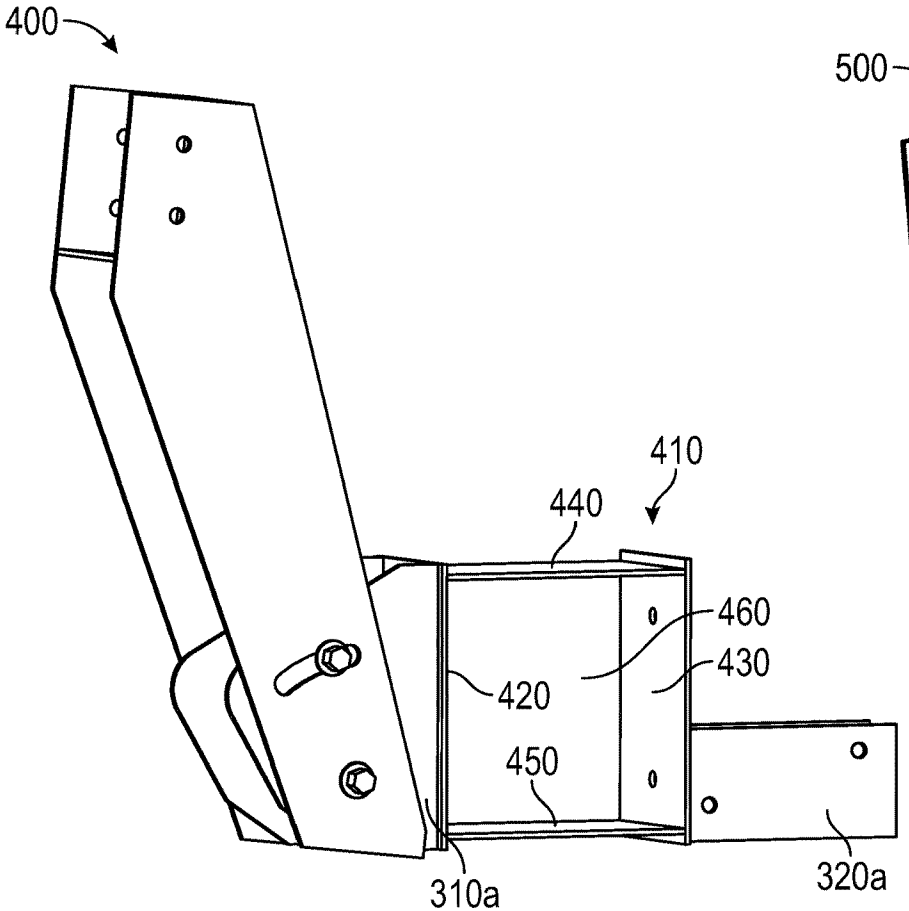
FIG. 4 is a further embodiment of adjustable bracket for raising a patio roof.

With reference to FIGS. 4 and 5, further embodiments of adjustable brackets 400, 500 for raising a patio roof will be described. Like reference numbers in FIGS. 4 and 5 to those shown and described in FIGS. 1-3, which is incorporated herein, are shown with the same reference number, but with an "a" or "b" suffix.

The adjustable bracket 400 is the same as adjustable bracket 300, except that a rain gutter support assembly 410 is incorporated into the adjustable bracket 400, between the rectangular flat plate 310*a* and parallel rafter attachment plates 320*a*. The rain gutter support assembly 410 has a rectangular (e.g., square) configuration, and is constructed of four attached plates 420, 430, 440, 450. The rain gutter support assembly 410 includes a central rain gutter receiving area 460 that a rain gutter is disposed through.

The adjustable bracket 500 is the same as adjustable bracket 10, except that rain gutter support assembly 410*b*, which is the same as that described with respect to FIG. 4 and incorporated herein, is incorporated/attached onto the rectangular flat plate 120*b* in adjustable bracket 500. The rain gutter support assembly 410*b* includes a central rain gutter receiving area 460*b* that a rain gutter is disposed through.

In use, a rain gutter is removed from the house, the adjustable bracket 400, 500 is attached to the rafters or fascia 30, and the rain gutter is inserted through the rain gutter receiving area 460, 460*b*. In addition to being supported by the rain gutter support assembly 410, 410*b*, the rain gutter may be attached to the rain gutter support assembly 410, 410*b*.

While various embodiments of the present invention have been described above, it should be understood that they have been presented by way of example only, and not of limitation. Likewise, the various diagrams may depict an example architectural or other configuration for the disclosure, which is done to aid in understanding the features and functionality that can be included in the disclosure. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

As will become apparent to one of ordinary skill in the art after reading this document, the illustrated embodiments and their various alternatives can be implemented without confinement to the illustrated examples.

I claim:

1. An adjustable bracket for raising a patio roof, comprising:

a. an attachment mechanism attachable to a fascia or a rafter;

b. a bracket mechanism configured to extend from and raise, support, and attach a patio roof member or a joist at least 12 inches above a bottom of the fascia or a bottom of the rafter;

c. an adjustment mechanism to provide an adjustment angle of the bracket mechanism relative to the attachment mechanism to accommodate different roof angles, wherein the attachment mechanism includes a rectangular flat plate that is coupleable to the fascia or the rafter, parallel flanges extending perpendicularly from the plate, and the flanges each include a hole that receives a fastener to secure the adjustment angle of the bracket mechanism relative to the attachment mechanism, the bracket mechanism includes elongated parallel side walls having a proximal end adjacent to the attachment mechanism and a distal end configured to raise, support, and attach the patio roof member or the joist, the parallel flanges of the attachment mechanism and the elongated parallel side walls of the bracket mechanism pivotally connected to each other at a first location along the elongated parallel side walls of the bracket mechanism adjacent to the proximal end of the bracket mechanism, and movably securable to each other at a second location along the elongated parallel side walls of the bracket mechanism that is distal to the first location and proximal to the distal end of the bracket mechanism.

2. The adjustable bracket of claim 1, wherein the adjustable bracket includes a rain gutter support assembly attached to the rectangular flat plate.

3. The adjustable bracket of claim 1, wherein the attachment mechanism includes perpendicularly extending, parallel rafter attachment plates, and a support plate joining the attachment plates to form a recess between the attachment plates to accommodate a rafter for connection therewith.

4. The adjustable bracket of claim 3, wherein the adjustable bracket includes a rain gutter support assembly between the rectangular flat plate and the parallel rafter attachment plates.

5. The adjustable bracket of claim 1, wherein the bracket mechanism includes an end wall spanning the elongated parallel side walls, and an internal support structure.

6. The adjustable bracket of claim 1, wherein the adjustable bracket is sized to raise the patio roof at least 24 inches above a bottom of the fascia board or rafters.

* * * * *